US006354449B1

(12) United States Patent
Smith

(10) Patent No.: US 6,354,449 B1
(45) Date of Patent: Mar. 12, 2002

(54) NIPPLE ADAPTER

(76) Inventor: Louis F. Smith, 7472 Wyndham Pkwy., Helena, AL (US) 35080-3383

( * ) Notice: Subject to any disclaimer, the term of this patent is extended or adjusted under 35 U.S.C. 154(b) by 0 days.

(21) Appl. No.: 09/584,560

(22) Filed: May 31, 2000

(51) Int. Cl.[7] ..... A61J 9/00
(52) U.S. Cl. ..... 215/11.1; 215/11.6
(58) Field of Search ..... 215/11.1, 344, 215/11.6

(56) References Cited

U.S. PATENT DOCUMENTS

| | | | | |
|---|---|---|---|---|
| 5,024,341 A | | 6/1991 | Dekerle | |
| 5,312,282 A | * | 5/1994 | Cooper | 446/27 |
| 5,419,445 A | * | 5/1995 | Kaesemeyer | 215/11.1 |
| D414,873 S | | 10/1999 | Kwiecinski | |
| 6,089,389 A | * | 7/2000 | Sharon et al. | 215/11.1 |
| 6,112,919 A | * | 9/2000 | Ho | 215/11.4 |

* cited by examiner

*Primary Examiner*—Allan N. Shoap
*Assistant Examiner*—Lien Ngo

(74) *Attorney, Agent, or Firm*—Joseph B. Birkner

(57) ABSTRACT

A nipple adapter in the form of a unitary assembly for receiving the external thread of a bottle with a narrow neck is disclosed. The nipple adapter may be fitted to commercially available bottles and containers having a wide variety of beverage contents such as water, mineral water, juice, milk and soda pop. The nipple adapter has a cover, a nipple with a flange, a seal and a housing. The cover has an inner shelf extending circumferentially around an interior face of the cover. The inner shelf has an inner land and a negative angular portion extending from the inner land to the interior face of the side wall of the cover defining a triangular cross section. The housing has an outer shelf disposed on and extending circumferentially around an outer annular wall. The outer shelf has an outer land extending from the outer annular wall and a positive angular portion extending from the outer land to the outer annular wall defining a triangular cross section. An inner annular wall of the housing has a bevel disposed thereon for the seal and an interior thread disposed within a bore of the inner annular wall for receiving the external thread of the bottle. The housing is permanently joined to the cover in a mating relationship to form the unitary assembly such that the flange of the nipple is retainably disposed therein the cover.

8 Claims, 1 Drawing Sheet

NIPPLE ADAPTER

FIELD OF THE INVENTION

This invention relates generally to a nipple adapter for a bottle having an outer threaded neck such as a beverage bottle. More particularly, the present invention relates to a nipple adapter that is of a unitary assembly which may be fitted to commercially available bottles and containers having a wide variety of beverage contents such as water, mineral water, juice, milk and soda pop.

BACKGROUND OF THE INVENTION

Feeding bottles for infants typically have a nipple which is inserted into a cover. The cover typically has a screw thread which allows the cover and nipple to be screwed onto a filled baby bottle. The usual practice is to prepare various bottles having desired contents in advance of a trip, a walk or a family visit so that the infant may be fed. Unfortunately, this is inconvenient since space is often at a premium especially when a parent or guardian typically is carrying other baby accessories. Also, the weight of bottles is cumbersome and the contents are often subject to spills and potential spoilage.

U.S. Pat. No. 5,024,341 to Derkerle, shows a nipple adapter for a bottle comprising a screw ring. The invention utilizes two threaded components, a screw ring 15 and a threaded end-piece adapter 10 for attaching the nipple assembly to the neck of a threaded bottle 11.

U.S. Pat. No. Des. 414,873 to Kwiecinski shows an ornamental scalloped shaped design for an infant nipple adapter system with an external and an internal threaded portion. A ring with an internal thread contains the nipple to the dual threaded adapter which is attached to the neck of a threaded bottle as seen in FIG. 2.

Both Derkerle and Kwiecinski discussed above have similar disadvantages in that separate pieces of the nipple adapters are needed for assembly by the user. Also, the separate pieces may be damaged or lost during use, particularly the externally threaded parts, thereby making the intended bottle conversion unusable.

In view of the above mentioned problems and limitations associated with nipple adapter systems, it was recognized by the present inventor that there is a need for an improved nipple adapter that has an integral structure which has a threaded portion directly adaptable to the threaded neck portion of a bottle so that a user may purchase various readily available beverages at a store and be able to use the nipple adapter with such beverages thereby saving time and also being able to provide a fresh beverage when needed without the need to prepare in advance and transport such beverages.

Also, the present inventor recognized the unfulfilled need to provide a nipple adapter for a bottle such as a soft drink beverage bottle type with the nipple permanently captured in a one-piece exterior cap portion thereby providing a unitary assembly which is preassembled and one which is convenient to use while avoiding the problems and limitations associated with attempts made by earlier inventors.

Accordingly, it becomes clear that there is a great need for a nipple adapter that has a unitary assembly, rather than a nipple adapter for a bottle having numerous separate components which require assembly by a user.

SUMMARY OF THE INVENTION

It is therefore an object of this invention to provide a nipple adapter having a permanent unitary assembly which avoids the aforementioned problems of prior art devices.

It is also an object of this invention to provide a nipple adapter which may be adapted to fit the threaded neck portion of a bottle so that a user may purchase various readily available beverages at a store and be able to use the nipple adapter with such beverages thereby saving time and also being able to provide a fresh beverage when needed without the need to prepare in advance and transport such beverages.

It is also an object of this invention to provide a nipple adapter which may be manufactured from readily available materials by conventional manufacturing processes.

It is still a further object of this invention to provide a nipple adapter that is simple in design, simple to manufacture, low in cost and easy to use.

This invention results from the realization that there is a great need for a nipple device that can be used on a bottle with a mouth smaller in size than that on a standard baby bottle, particularly a nipple adapter with an integral structure which has a threaded portion directly adaptable to the threaded neck portion of a bottle. The resulting invention provides a user the capability of conveniently being able to provide a fresh beverage to an infant when needed without having to prepare in advance and transport such beverages.

The above and the other objects are achieved in accordance with the present invention, which, according to one aspect, provides a nipple adapter in the form of a unitary assembly for receiving the external thread of a bottle with a narrow neck. The nipple adapter, cylindrical in shape, has a cover, a nipple with a flange, a seal and a housing. The cover has an inner shelf, triangular in shape, extending circumferentially around an interior face of the cover. The inner shelf has an inner land and a negative angular portion extending from the inner land to the interior face of the side wall of the cover. The housing has an outer shelf, triangular in shape, disposed on and extending circumferentially around an outer annular wall of the housing. The outer shelf has an outer land extending from the outer annular wall and a positive angular portion extending from the outer land to the outer annular wall. An inner annular wall of the housing has a bevel disposed thereon for the seal and an interior thread disposed within a bore of the inner annular wall for receiving the external thread of the bottle. The housing is permanently joined to the cover in a mating relationship to form the unitary assembly such that the flange of the nipple is retainably disposed therein the cover.

Other aspects provide additional details and features of the invention.

DETAILED DESCRIPTION OF PREFERRED EMBODIMENTS

Figure 1:
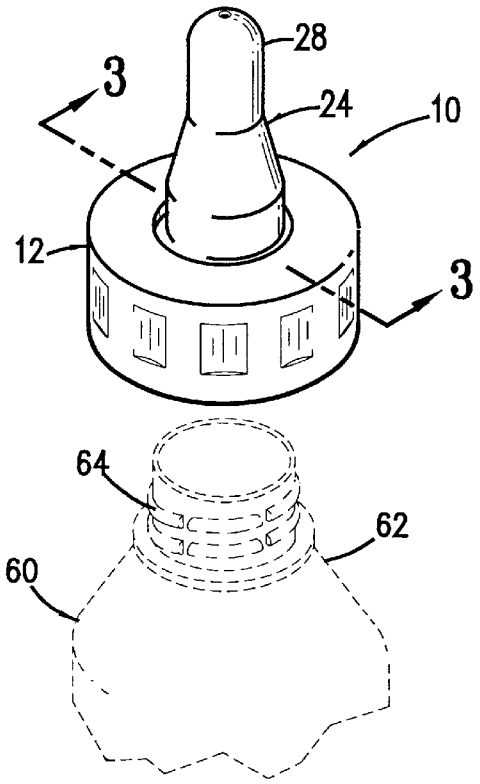
FIG. 1 is a perspective view of a preferred embodiment of a nipple adapter of the instant invention with a bottle having a neck and a thread shown in phantom.
Figure 2:
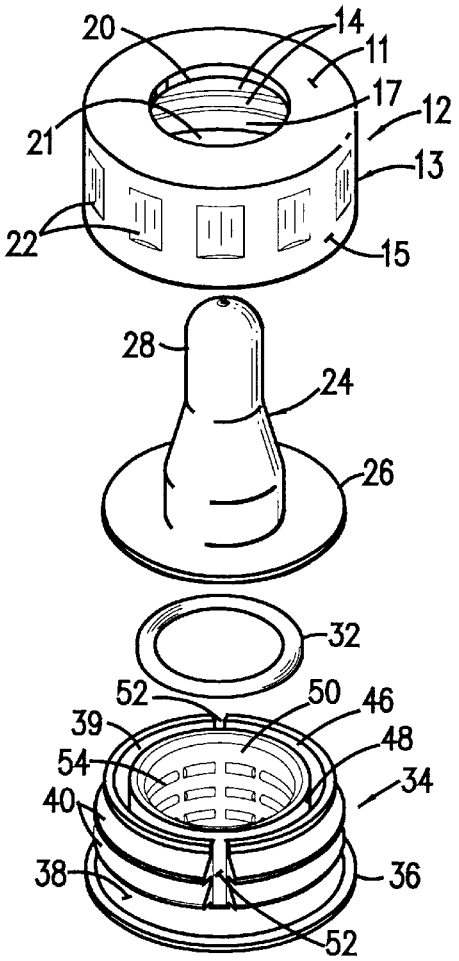
FIG. 2 is a perspective view of a preferred embodiment of the nipple adapter of FIG. 1 showing the nipple adapter components, namely a cover, a nipple, a seal, a housing and, FIG. 3 is an enlarged cross sectional view of a preferred embodiment of the nipple adapter of FIG. 1 taken along the line 3—3 showing the construction of the nipple adapter with the thread of bottle shown in phantom inserted therein.
Figure 3:
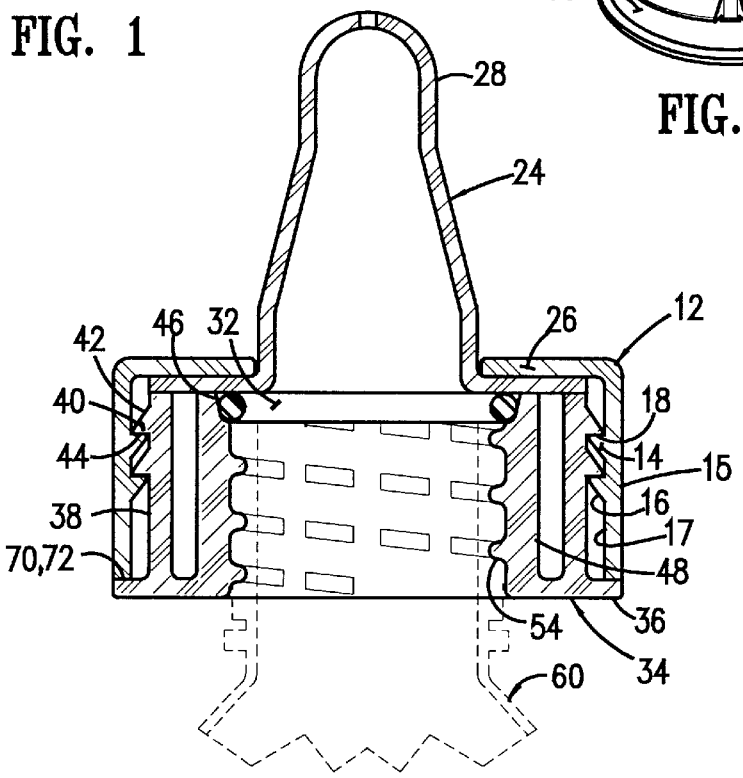

Looking more particularly to the drawings, there is shown in FIGS. 1–3 a preferred embodiment of a nipple adapter, which is generally indicated at 10 according to a preferred embodiment of the present invention.

Essentially, the nipple adapter 10 allows a bottle with a small diameter threaded portion, ie. a bottle with a narrow mouth, to be readily usable with a standard baby bottle nipple which is typically sized to fit onto a bottle having a wider mouth than the mouth of a standard beverage bottle.

The nipple adapter 10, is provided in the form of a unitary assembly having an interior thread 54 which is used for receiving an exterior thread 64 of a bottle 60 having a neck 62 such as a beverage bottle shown in phantom in FIG. 1 and in FIG. 3, commonly available in stores which may contain milk, water, juice or other beverage. Infants, may thereby directly obtain nourishment via a nipple 24 without the need to employ a baby bottle when the nipple adapter 10 is screwed onto the exterior thread 64 of the bottle 60.

Referring to FIG. 2 and to FIG. 3 it can be seen that the nipple adapter 10 of FIG. 1 essentially comprises a cover 12, the nipple 24 having a teat 28 and a flange 26, a seal 32 and a housing 34.

The cover 12, cylindrical in shape, has a top wall 11 with an aperture 20 therein, a side wall 13 having an exterior face 15 and an interior face 17 with the side wall 13 extending from the top wall 11 and defining an open end 21 and an inner shelf 14 disposed on and extending circumferentially around the interior face 17 of the cover 12. The inner shelf 14 has an inner land 18 extending from the interior face 17 and a negative angular portion 16 extending from the inner land 18 to the interior face 17 of the side wall 13 of the cover 12.

The housing 34, cylindrical in shape, includes a base 36, an outer annular wall 38 extending upwardly from the base 36 defining an outer open end 39, an inner annular wall 48 centrally disposed on the base 36 in a spaced relationship from the outer annular wall 38 and extending upwardly from the base 36 and defining a bore 50 therein. The housing 34 has an outer shelf 40 disposed on and extending circumferentially around the outer annular wall 38 of the housing 34. The outer shelf 40 has an outer land 44 extending from the outer annular wall 38 and a positive angular portion 42 extending from the outer land 44 to the outer annular wall 38. The inner annular wall 48 of the housing 34 has a bevel 46 disposed thereon for the seal 32 and an interior thread 54 disposed within the bore 50 of the inner annular wall 48 for receiving the external thread 64 of the bottle 60. A means for joining the housing 34 to the cover 12 to form the unitary assembly of the nipple adapter 10 such that the flange 26 of the nipple 24 is retainably disposed therein the cover 12 is provided.

FIG. 3 which is a cross sectional view of a preferred embodiment of the nipple adapter 10 of FIG. 1 taken along the line 3—3 shows the construction of the nipple adapter 10 with the exterior thread 64 of the bottle 60 shown in phantom inserted therein. The nipple 24 is fitted into the cover 12 so that the teat 28 of the nipple 24 passes through the aperture 20 in the cover 12 and the flange 26 of the nipple 24 rests inside the cover 12.

The means for permanently joining the housing 34 in a mating relationship to the cover 12 to form a unitary assembly includes the outer annular wall 38 of the housing 34 having a slot 52 partially longitudinally extending along and disposed on at least two locations of the outer annular wall 38 for allowing the housing 34 to be releasably contracted a sufficient amount to allow the housing 34 to be fitted into the cover 12 during assembly such that the outer land 44 of the housing 34 contacts the inner land 18 of the cover 12 and a portion of the housing 34 compressively contacts the flange 26 of the nipple 24 and the seal 32 compressively contacts the flange 26 of the nipple 24 thereby permitting the housing 34 to create a liquid impervious connection therebetween and the cover 12 and the housing 34 being held together in a mating relationship when the housing is releasably expanded and the housing 34 rests in the cover 12.

The outer shelf 40 and the inner shelf 14 are dimensioned to allow sufficient clearance between the flange 26 of the nipple 24 and the housing 34 and the cover 12 so that the flange 26 of the nipple 26 is compressively retained and the cover 12 and the housing 34 are held together in a mating relationship and the negative angular portion 16 of the cover 12 and the positive angular portion 42 of the housing 34 are cooperatively engaged with the inner land 18 and with the outer land 44. Preferably, inner shelf 14 of the cover 12 and the outer shelf 40 of the housing are both triangular in cross section with the negative angular portion 16 of the inner shelf 14 and the positive angular portion 42 of the outer shelf 40 both about 45 degrees and the inner land 18 and the outer land 44 being equal in length.

To further ensure that the cover 12 and the housing 34 are securely held together, and to prevent unwanted rotation of the cover 12 and the housing 34 during use, preferably, the means for permanently joining the housing 34 to the cover 12 to form a unitary assembly by fixing the cover 12 to the housing 34 may further include one of an adhesive (not shown) applied to the cover 12 and to the base 36 of the housing 34 and a welded heat seal (not shown) disposed about the base of the housing 34 and the cover 12 so that the nipple 24 is permanently and non removably contained within the unitary assembly. Although not necessary for operation, the cover 12, preferably, may be provided with a friction grip 22 on the exterior surface to facilitate assembly.

Preferably, the cover 12 and the housing 34 of the nipple adapter 10 may be fabricated from readily available materials by conventional fabrication techniques. For example, the cover 12 and the housing 34 may be made of plastic and may be fabricated by plastic molding as well as by conventional material bonding and assembly methods such as by the use of adhesives and by heat seal welding. The nipple 24 and the seal 32 are made of an elastomeric material.

The nipple adapter 10 is provided pre-assembled as a unitary assembly, ie. a one piece permanent assembly, as mentioned, and is ready to use without any need to assemble the components by a user. Assembly is accomplished by placing the nipple 24 into the cover 12 and the seal 32 into the groove 46 of the housing 34 and joining the housing 34 to the cover 12 by inserting the housing 34 into the cover 12. Due to the novel threadless interlocking assembly design features mentioned above, a positive connection therebetween the cover 12 and the housing 34 is achieved. Preferably an adhesive may be applied to the cover 12 and to the base 36 of the housing 24 prior to joining to further secure the components or they may be joined by a heat seal weld after the cover 12 and the housing 34 are in a mating relationship. The completed nipple assembly 10 may be screwed onto the exterior thread 64 of the bottle 60 of FIG. 1 and of FIG. 3 for immediate use. The nipple adapter 10 may be constructed in a wide variety of sizes, colors and style variations and may be readily adapted to fit the threads of various bottle sizes and may also have artistic decorations (not shown) thereon.

Surprisingly, the instant invention provides an added advantage and recognizes a problem and adequately and completely addresses an unfulfilled need, in that a fully assembled nipple adapter 10 is provided without the need for a user to self assemble miscellaneous components.

One practical advantage of the invention is that it provides an efficient, convenient, practical, safe, low cost, versatile nipple adapter 10 which readily fits a wide variety of standard beverage bottles which permits easy feeding options for an infant.

A further advantage of the invention is that the nipple adapter 10 is designed for ease of manufacture by standard methods and by using readily available materials.

Of course, a wide variety of further uses and advantages of the present invention will become apparent to one skilled in the art.

As disclosed, it is apparent that the instant invention can provide other options. One skilled in the art will realize that the foregoing discussion outlines the more important features of the invention to enable a better understanding of the instant invention and to instill a better appreciation of the inventor'contribution to the art. It must be clear that the disclosed details of construction, descriptions of geometry and illustrations of inventive concepts are mere examples of possible manifestations of the invention.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A nipple adapter for receiving the external thread of a bottle with a narrow neck, said nipple adapter comprising:

a cover, cylindrical in shape, having a top wall with an aperture therein, a side wall having an exterior face and an interior face and said side wall extending from said top wall and defining an open end, an inner shelf disposed on and extending circumferentially around said interior face of said cover; said inner shelf having an inner land extending from said interior face and a negative angular portion extending from said inner land to said interior face of said side wall of said cover defining a triangular cross section;

a nipple having a flange;

a seal;

a housing, cylindrical in shape, having a base, an outer annular wall extending upwardly from said base defining an outer open end, an inner annular wall centrally disposed on said base in a spaced relationship from said outer annular wall and extending upwardly from said base and defining a bore therein;

said housing having an outer shelf disposed on and extending circumferentially around said outer annular wall of said housing; said outer shelf having an outer land extending from said outer annular wall and a positive angular portion extending from said outer land to said outer annular wall defining a triangular cross section;

said inner annular wall of said housing having a bevel disposed thereon for said seal and an interior thread disposed within the bore of said inner annular wall for receiving the external thread of the bottle; and means for permanently joining said housing in a mating relationship to said cover to form a unitary assembly such that said flange of said nipple is retainably disposed therein said cover.

2. The nipple adapter of claim 1 wherein said negative angular portion of said inner shelf of said cover is about 45 degrees and said positive angular portion of said outer shelf of said housing is about 45 degrees.

3. The nipple adapter of claim 2 wherein said inner land of said inner shelf of said cover is equal in length to said outer land of said outer shelf of said housing.

4. The nipple adapter of claim 3 wherein said means for permanently joining said housing in a mating relationship to said cover to form a unitary assembly includes said outer annular wall of said housing having a slot for allowing said housing to be releasably contracted a sufficient amount to allow said housing to fit into said cover such that said outer land of said housing contacts said inner land of said cover in a mating relationship when said housing is releasably expanded and a portion of said housing compressively contacts said flange of said nipple whereby said cover and said housing being held together when said housing rests in said cover.

5. The nipple adapter of claim 4 wherein said outer shelf and said inner shelf are dimensioned to allow sufficient clearance between said housing and said cover so that said nipple is retained when said cover and said housing are cooperatively engaged with said inner land and said outer land.

6. The nipple adapter of claim 5 wherein said cover and said housing are plastic and are each fabricated by plastic molding.

7. The nipple adapter of claim 6 wherein said means for permanently joining said housing in a mating relationship to said cover to form a unitary assembly further includes one of an adhesive applied to said cover and to said base of said housing and a welded heat seal disposed about said base of said housing and said cover so that said nipple is permanently and non removably contained within said unitary assembly.

8. The nipple adapter of claim 7 wherein said cover has a friction grip disposed on said exterior face of said side wall.

* * * * *